US006282397B1

(12) United States Patent
Tanioka

(10) Patent No.: US 6,282,397 B1
(45) Date of Patent: Aug. 28, 2001

(54) TRANSFER AND FIXING DEVICE FOR ELECTROPHOTOGRAPHIC IMAGE FORMING APPARATUS WITH IMPROVED CLEANING SYSTEM

(75) Inventor: Yoshiyasu Tanioka, Niigata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/621,999

(22) Filed: Jul. 21, 2000

(30) Foreign Application Priority Data

Jul. 22, 1999 (JP) ..... 11/1207124

(51) Int. Cl.[7] ..... G03G 21/00; G03G 15/20; G03G 15/16

(52) U.S. Cl. ..... 399/307; 399/326; 399/327

(58) Field of Search ..... 399/307, 352, 399/357, 101, 326, 327; 15/256.51, 256.52

(56) References Cited

U.S. PATENT DOCUMENTS

| | | | | |
|---|---|---|---|---|
| 4,136,613 | * | 1/1979 | Namiki | 118/60 |
| 4,479,709 | * | 10/1984 | Syukuri et al. | 399/357 |
| 5,701,559 | * | 12/1997 | Ootaka et al. | 399/149 |
| 5,761,600 | * | 6/1998 | Murata | 399/403 |
| 5,970,281 | * | 10/1999 | Park | 399/101 |
| 6,035,176 | * | 3/2000 | Byeon | 399/345 |

FOREIGN PATENT DOCUMENTS

| | | | |
|---|---|---|---|
| 59-111673 | * | 6/1984 | (JP) . |
| 59-135473 | * | 8/1984 | (JP) . |
| 7191525 | | 7/1995 | (JP) . |
| 7205336 | | 8/1995 | (JP) . |
| 9-114269 | | 5/1997 | (JP) . |

* cited by examiner

*Primary Examiner*—Quana M. Grainger
(74) *Attorney, Agent, or Firm*—Ostrolenk, Faber, Gerb & Soffen, LLP

(57) ABSTRACT

The present invention provides a transfer and fixing device for an electrophotographic image forming apparatus, wherein a belt of a photosensitive member is conveyed between a backup roller and a primary roller toward the direction indicated by an arrow, while printed sheets of paper are conveyed between a fixing roller for secondary transcription and fixing and a primary transfer roller, wherein a cleaning belt revolved by two grinding rollers is disposed at one side of the primary transfer roller, while a grinding layer is formed on the surface of the cleaning belt, wherein the cleaning belt and the two grinding rollers are housed in a case, and the case is allowed to travel along a direction of an arrow by a cam, and wherein the grinding layer shaves off the deteriorated portions by making contact with the rubber layer of the primary transfer roller when the rubber layer of the primary transfer roller formed on the surface of the primary transfer layer has been depleted.

8 Claims, 3 Drawing Sheets

TRANSFER AND FIXING DEVICE FOR ELECTROPHOTOGRAPHIC IMAGE FORMING APPARATUS WITH IMPROVED CLEANING SYSTEM

BACKGROUND OF THE INVENTION

1. Field of the Invention

The present invention relates to an electrophotographic image forming apparatus. The present invention particularly relates to a transfer and fixing device for the electrophotographic image forming apparatus in which deteriorated portions on a silicone rubber with ozone and the like is removed by grinding particularly when the silicone rubber is used as a surface layer of a primary transfer roller for printing by taking advantage of surface tension differences.

2. Description of the Related Art

As a conventional art of an electrophotographic image forming apparatus, Japanese Unexamined Patent Publication (JP-A) No. 9-114269 discloses a primary transfer roller using a tubular core metal made of aluminum as a base on which rubber is coated as a lining. A conductive film made of a polycarbonate or tetrafluoroethylene resin is wound around the roller.

A toner image is firstly formed by allowing toner to adhere on a photosensitive roller charged with an electrification device. This toner image is transferred to a primary transfer roller by pressing the photosensitive roller onto the primary roller while taking advantage of a bias potential impressed on the primary transfer roller. However, it was a problem that transfer performance such as transfer efficiency is declined since the surface layer of the primary transfer roller is degenerated by the bias potential impressed during transcription.

For solving the problem above, conductive film portions on the surface of the primary transfer roller is ground by allowing a grinding device to contact the primary transfer roller, when resistance on the surface of the primary transfer roller as measured with a resistance measuring apparatus has decreased to below a permissible limit value. Grinding is stopped when the resistance level obtained by simultaneously measuring the resistance falls within the permissible range.

When a silicone rubber is used for the surface material of the primary transfer roller, on the other hand, the rubber layer covering the surface of the roller is formed by injection molding or extrusion processing of the silicone rubber, followed by a grinding finish after forming heat bridge bonds. However, the rubber layer may be also deteriorated due to ozone denaturation of the rubber layer, or because low molecular weight components that are not bound by bridge bonds (non-bridge bond portions) may efflux as a result of insufficient polymerization in the rubber layer.

Surface tension changes accompanied by deterioration of the rubber layer material also arises a decreased printing quality. This is because the critical surface tension of the surface layer of the primary transfer roller is required to be larger than the surface tension of a belt of the photosensitive surface layer, since transfer of the toner image from the surface layer of the belt of the photosensitive surface layer to the surface layer of the primary transfer roller is controlled by the difference between the critical surface tension of the belt of the photosensitive surface layer and the critical surface tension of the surface layer of the primary transfer roller.

Adhesive force between the surface layer of the primary transfer roller and the toner image should be suppressed to be lower than the adhesive force between the printing paper and the toner image, in order to readily peel the sheet of paper from the primary transfer roller after the image has been subjected to secondary transcription and fixing on the printing paper.

The range between the upper limit and the lower limit of the critical surface tension of the surface of the primary transfer roller should be strictly restricted for the purpose above.

The service life of the roller is shortened since adhesion of fine ink particles on the surface layer of the primary transfer layer can not be avoided due to processing limitations in forming the surface of the primary transfer roller, also producing a problem yet to be solved by some simple means.

It is also an additional problem that the grinding member is plugged by grinding with the primary transfer roller when a grinding roller is used, thereby grinding force is reduced since the grinding material side is abraded. Although the circumference length of the grinding member should be elongated for prolonging the service life of the grinding member, the problem is only solved by increasing the roller diameter when the grinding roller is used. However, increasing the roller diameter is contradictory to the requirement of saving the installation space of the equipment.

SUMMARY OF THE INVENTION

Accordingly, an object of the present invention is to provide a transfer and fixing device for an electrophotographic image forming apparatus that can maintain the critical surface tension of the surface of the primary transfer roller at an appropriate level.

An another object of the present invention is to prolong the service life of a grinding device for grinding the surface of the primary transfer roller.

The present invention for attaining the foregoing objects provides a transfer and fixing device for an electrophotographic image forming apparatus comprising a primary transfer roller on which a toner image formed on a photosensitive member is transferred from the photosensitive member by a difference of critical surface tension between the roller and the photosensitive member, wherein the transferred toner image is transferred on a sheet of printing paper by a difference of critical surface tension between the roller and the sheet of printing paper. The present invention also provides a cleaning belt for grinding the surface layer of the primary transfer layer to remove depleted portions on the surface layer of the primary transfer roller by allowing the belt to press onto the surface of the primary transfer roller, and two rollers for allowing the cleaning belt to revolve.

DESCRIPTION OF THE PREFERRED EMBODIMENT

The structure of a conventional electrophotographic image forming apparatus will be described at first with reference to FIG. 1 for enhancing to understand the present invention.

Figure 1:
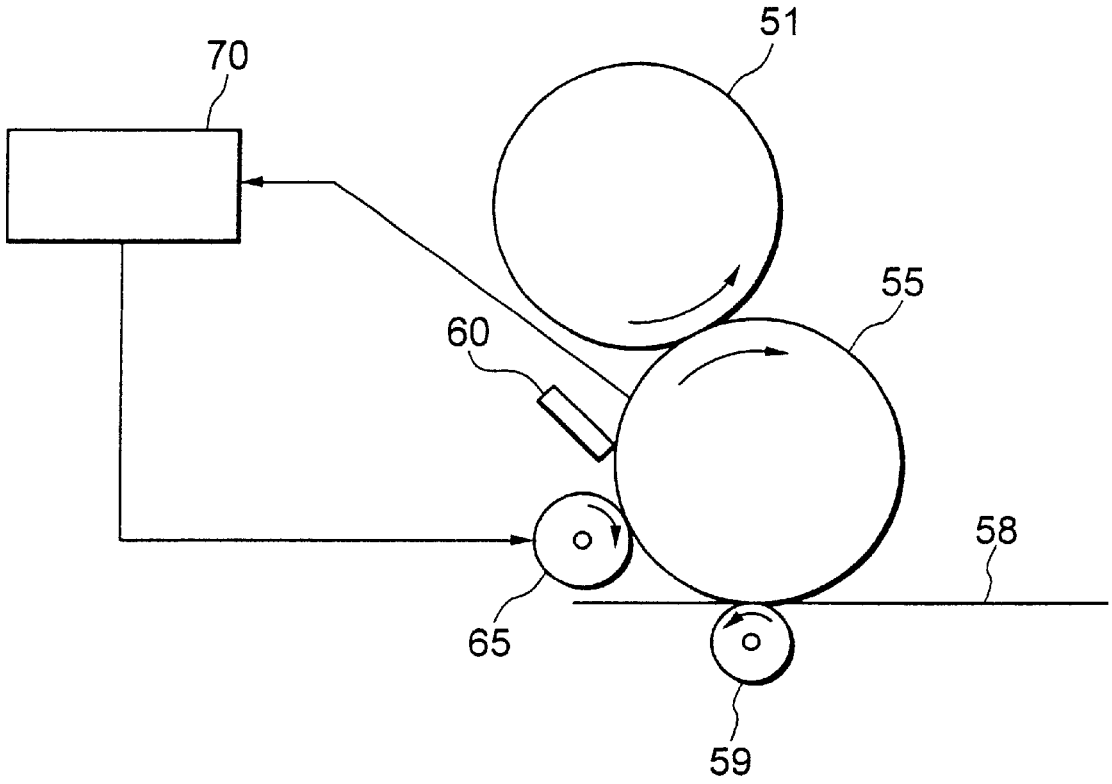
FIG. 1 PRIOR ART
FIG. 1 is a front view showing the structure of a conventional electrophotographic image forming apparatus.

In FIG. 1, an image forming roller 51 rotates counterclockwise to transfer the toner image formed on the image forming roller 51 onto an intermediate transfer roller 55 rotating clockwise as a primary transfer image. The primary transfer image on the intermediate transfer roller 55 is transferred on to recording medium 58 as a secondary transfer image via the transfer roller 59, when the intermediate transfer roller 55 rotates clockwise. A cleaning device 60 cleans the intermediate transfer roller 55 after the secondary transcription. While a grinding roller 65 is able to make contact with and be retracted from the intermediate transfer roller 55, the grinding roller 65 grinds depleted layers on the surface of the intermediate transfer roller 55 when the former comes in contact with the latter. A resistance measuring device 70 measures electric resistance of the intermediate transfer roller 55 after the secondary transcription, and allows the grinding roller 65 to repeat contact with and retraction from the intermediate transfer roller 55 in response to the result of the measurement.

Subsequently, an embodiment of the present invention will be described in detail with reference to FIGS. 2 and 3.

Figure 2:
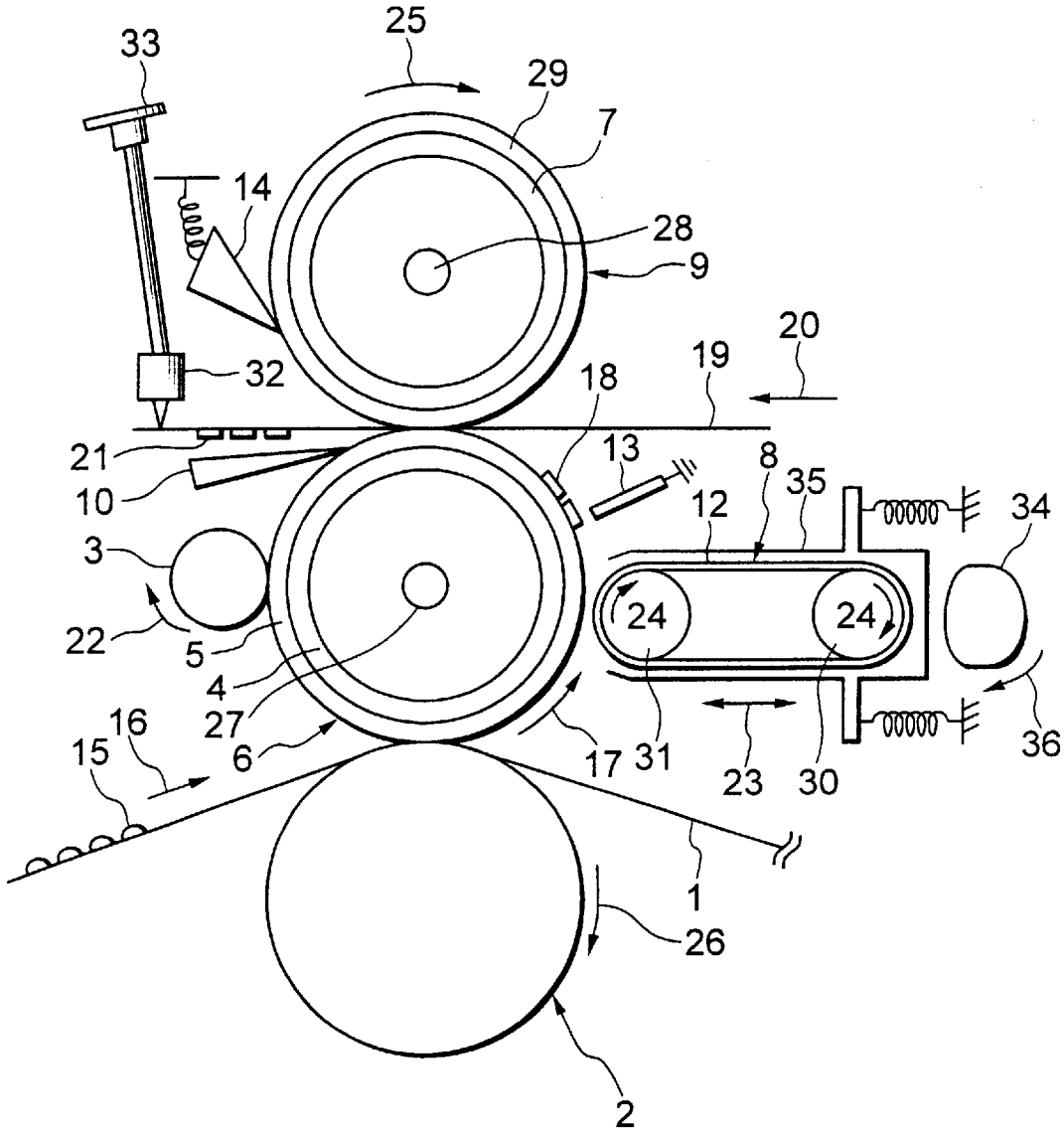
FIG. 2 is a front view showing the structure of an electrophotographic image forming apparatus according to an embodiment of the present invention.

With reference to FIG. 2, the image forming apparatus according to the embodiment of the present invention comprises a belt of a photosensitive member 1, a backup roller 2 for primary transcription, a primary transfer roller 6, and a fixing roller 9 for simultaneous secondary transfer and fixing.

The primary transfer roller 6 is a composite roller comprising a hollow aluminum core 4 and a primary transfer rubber layer 5 formed on the surface of the core. A heat source 27 is disposed within the space of the hollow aluminum core.

The fixing roller 9 is a composite roller comprising a hollow aluminum core 7 on which a resin coating 29 is applied. A heat source 28 is disposed within the inner space of the aluminum core 7, and the parting plate 14 is disposed to be in contact with the surface layer of the fixing roller 9.

A cleaning roller 3 serves to remove a residual ink that has not been transferred onto a sheet of paper placed on the primary transfer roller 6, and is disposed so as to contact the primary transfer roller 6.

The parting plate 14 is disposed at a distance apart, usually a distance of 0.1 to 0.2 mm, from the primary transfer roller 6.

A cleaning belt 8 serves to shave the depleted rubber layer 5 on the primary transfer roller 6, and is held by a mechanism to allow the belt to be freely pressed on the primary transfer roller 6 or released from press-contact with the primary transfer roller 6. The cleaning belt 8, on the surface of which a grinding layer 12 is formed, revolves around a roller 30 and a roller 31.

A de-electrifier 13 serves to remove frictional electrification generated between the primary transfer roller 6 and the cleaning belt 8, and is disposed so as not to contact the primary transfer roller 6.

Each element will be described in detail hereinafter.

The belt of the photosensitive member 1 comprises a photosensitive layer on a polymer film substrate, and a coating film with low surface tension is formed on the uppermost photosensitive layer. PET (polyethylene terephthalate), PEN (polyethylene naphthalate) or PI (polyimide) is preferably used for the substrate.

The polymer with low surface tension may be provided as silicone coating by forming bridge bonds at room temperature or at low temperature. However, the polymer with low surface tension may be formed of a silicone having high temperature bridge-bonds when PI is used for the substrate. While the backup roller 2 is made of a metal, a rubber layer may be formed on the surface.

The rubber layer 5 of the primary transfer roller is formed by injection molding or extrusion processing of a silicone rubber, and is finished into a film thickness of 0.5 to 5 mm by grinding after forming heat bridge bonds. The silicone rubber thus formed as a material of the rubber layer 5 of the primary transfer roller is preferably subjected to a hydrophobic treatment on a high temperature bridge bond (HTV) type base film. Reinforcing silica may be added to the high temperature bridge bond (HTV) type base film in order to endow the layer with durability.

A resin coating 29 on the fixing roller 9 is formed of a PTFE (polytetrafluoroethylene) resin or a PFA (a copolymer of tetrafluoroethylene and perfluoroalkyl vinyl ether) resin, or a mixture thereof. The resin coating 29 is manufactured to have a thickness of 15 to 30 $\mu$m.

The cleaning roller 3 comprises a core material made of an aluminum alloy, a stainless steel or a sulfur-containing free-machining steel on the surface of which a corrosion resistance treatment is applied, and has a rubber layer formed either by coating, injection molding or extrusion processing of polyurethane, EPDM (ethylene-propylene copolymer rubber), or a silicone or fluorosilicone rubber. The rubber layer has a film thickness of 0.5 to 5 mm, and its surface is machined to a given roughness by grinding.

The cleaning belt 8 serves to shave off deteriorated surface layers from the primary transfer layer 6. The rollers 30 and 31 for allowing the cleaning belt 8 to revolve may be formed of a metal such as an aluminum alloy, a stainless steel or a sulfur-containing free-cutting steel on the surface of which a corrosion resistance treatment is applied. Or, the roller may be formed of a thermoplastic crystalline resin or a thermoplastic amorphous resin. The resin may be reinforced with a glass fiber or an aramid fiber.

A PP (polypropylene) resin or a PET (polyethylene terephthalate) resin is used for the substrate of the cleaning belt 8.

A non-woven fabric or a substrate in the form of the non-woven fabric is spirally wound and adhered on the substrate of the grinding layer 12 of the cleaning belt 8.

The material of the substrate of the grinding layer 12 should be properly selected by taking durability, heat resistance and chemical resistance into consideration. The material of the grinding layer 12 is formed of a fiber of a plastic crystalline resin such as a PP (polypropylene) resin or a PET (polyethylene terephthalate) resin, and aluminum oxide or silicon carbide is added to the fiber as a grinding component. When reinforcement silica is added in the primary transfer roller 6, silicone carbide is selected for the grinding component so that the surface of the primary transfer roller 6 is uniformly ground and the grinding component is not so rapidly consumed.

The bulk weight (apparent density) of the non-woven fabric or the fabric should be determined within an appropriate range for exhibiting a function to confine the grinding powder shaven off from the primary transfer roller 6, and for uniformly grinding the surface of the primary transfer roller 6.

A stainless steel fiber formed into a brush or a non-woven fabric of a resin fiber subjected to a conductivity treatment is used for the material of the de-electrifier 13. The distance between the primary transfer roller 6 and the tip of the de-electrifier 13 is appropriately determined depending on the amount of surface electrification of the primary transfer roller 6.

The parting plates 10 and 14 may be formed of a metallic member such as stainless steel, steel and aluminum subjected to resin coating, or a liquid crystalline polymer or a heat-resistant resin such as a PPS (polyphenylene sulfide) or PEEK (polyether-ether-ketone) resin may be used for the parting plate. A fluorinated resin such as PTFE and PFA for use in the resin coating material may be supplemented with a reinforcement filler such as mica, besides adding a conductive agent if necessary.

The function of the transfer and fixing device in the embodiment according to the present invention will be described hereinafter with reference to FIG. 2.

A toner image 15 is formed on the belt of the photosensitive member 1. The toner image 15 has been developed in a development process not shown in FIG. 2. The toner assumes a liquid state in which ink components are dispersed in a liquid. The toner still contains a liquid besides solid fractions even when the toner has turned into a toner image 15 on the belt of the photosensitive member 1 after a development step and drying step (not shown).

The belt of the photosensitive member 1 revolves along a direction indicated by an arrow 16 to convey the toner image 15 at a tangent part between the backup roller 2 and the rubber layer 5 of the primary transfer roller.

The backup roller 2 is revolved along the direction of an arrow 26 to follow the movement of the belt of the photosensitive member 1. A load is applied between the backup roller 2 and the primary transfer roller 6, and a nip is formed at the tangent part. Th eprimary transfer roller 6 is controlled at a given temperature by being heated with a heat source 27 disposed within the roller.

The toner image 15 is simultaneously exposed to heat and pressure at the nip. A difference in the critical surface tension is provided between the belt of the photosensitive member 1 and the surface layer of the rubber layer 5 of the primary transfer roller by adjusting their bridge bond densities. The rubber layer 5 of the primary transfer roller is manufactured to always have a larger critical surface tension than that of the belt of the photosensitive member 1. Consequently, the toner image 15 is transferred onto the surface of the rubber layer 5 of the primary transfer roller having a larger critical surface tension. The liquid component contained in the toner image 15 evaporates in the transfer step described above.

The primary transfer roller 6 rotates along the direction of an arrow 17 following the movement of the belt of the photosensitive member 1 by frictional force. The toner image 18 transferred onto the primary transfer roller 6 is conveyed toward the tangent part between the fixing roller 9 and the primary transfer roller 6 by rotation of the primary transfer roller 6. The direction of rotation of the fixing roller 9 is indicated by an arrow 25. Since a load is applied on both rollers, a nip is formed at the tangent part. The sheet of printing paper 19 is conveyed along the direction indicated by an arrow 20 at the nip in synchronization with the belt of the photosensitive member 1 by a control device not shown in FIG. 2.

The sheet of printing paper 19 is dried by being fed with a heat energy from the surface of the primary transfer roller 6, and the surface of the fixing roller 9 is adjusted to an appropriate condition for transcription and fixing.

An image 21 is formed by transferring and fixing the toner image 18 on the surface of the sheet of printing paper 19 at the nip portion.

The sheet of printing paper 19 after completing transcription and fixing is peeled off, if necessary with the parting plates 10 and 14 to discharge the sheet of paper without being wound on the rollers 6 and 9.

The toner not transferred and fixed on the sheet of printing paper 19 in the transcription and fixing step, and remaining on the rubber layer 5 of the primary transfer roller, is transferred onto the cleaning roller 3 to remove the toner from the surface of the rubber layer 5 of the primary transfer roller.

While the material of the surface of the cleaning roller 3 has been already described, the density of the bridge bond is adjusted so that the critical surface tension of the surface material is always larger than the surface tension of the rubber layer 5 of the primary transfer roller, when silicone or fluorosilicone is used for the surface material.

After the entire surface of the cleaning roller 3 has been covered with the residual ink, the ink on the cleaning roller 3 also serves for removing the residual ink on the surface of the rubber layer 5 of the primary transfer roller.

The cleaning roller 3 is allowed to rotate along an arrow 22 following the movement of the primary transfer roller 6 by frictional force.

The surface of the rubber layer 5 of the primary transfer roller is gradually depleted by repeating the steps described above for every printing. The cause of depletion is due to ozone denaturation occurring in the step for electrification of the surface of the belt of the photosensitive member 1 not shown in FIG. 2. The critical surface tension is increased by enhancing efflux of the non-bridge bond portions of the silicone rubber formed on the surface of the rubber layer 5 of the primary transfer roller, when an organic solvent is used as the liquid. This is the cause of leaving fine particles of the ink component behind on the rubber layer 5 of the primary transfer roller.

For maintaining a normal function, the surface layer of the rubber layer 5 of the primary transfer roller should be mechanically shaved off.

The cleaning belt 8 serves as a belt revolving at a given speed by the rotation of the rollers 30 and 31 along the direction indicated by a narrow 24. Compression and release of compression on the surface of the rubber layer 5 of the primary transfer roller is made possible by allowing the grinding layer 12 on the cleaning belt 8 to travel along the direction of an arrow 23. It is also possible to make the cleaning belt 8 to be a little slack by elongating the length of the cleaning belt 8, in order to prolong the service life of the grinding member on the cleaning belt 8.

While the cleaning belt 8 is normally stopped at a distance apart from the surface of the rubber layer 5 of the primary transfer roller, the belt 8 comes in contact with the surface of the rubber layer 5 of the primary transfer roller at a prescribed interval and is then revolved by rollers 30 and 31.

The step for forming the toner image 15 on the surface of the belt of the photosensitive member 1 pauses while the grinding member 12 on the cleaning belt 8 is revolving by making contact with the rubber layer 5 of the primary transfer roller. The belt of the photosensitive member 1 only revolves for allowing the surface of the rubber layer 5 of the primary transfer roller to rotate.

Instructions for allowing the grinding layer 12 to press on the rubber layer 5 of the primary transfer roller, and instructions for allowing the grinding layer 12 to revolve are given by a control panel 33 having a counting function of the number of printed sheets of paper. The number of printed sheets of paper can be counted by a different device from the control panel 33.

Figure 3:
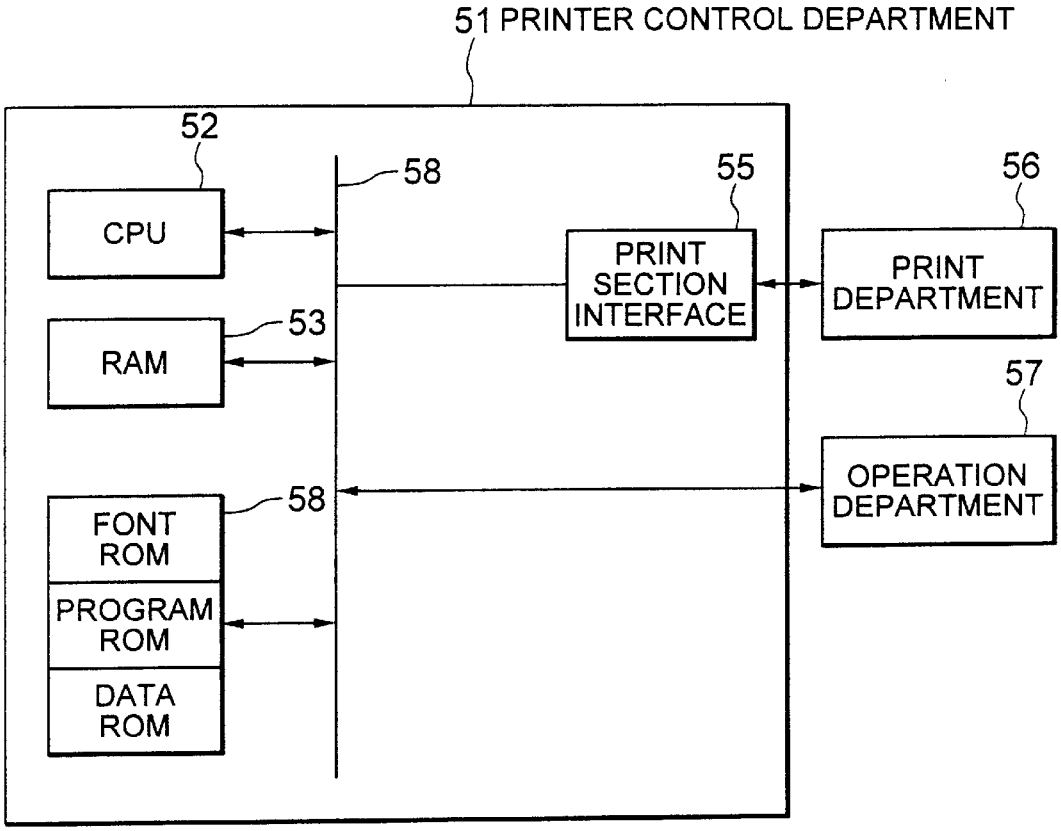
FIG. 3 is a block diagram of the control system of the electrophotographic image forming apparatus according to the embodiment of the present invention.

With reference to FIG. 3, the grinding interval for grinding the surface layer of the primary transfer layer can be controlled by designating the number of printed sheets of paper from an operation panel 57 in a printer controller 51 according to the present invention. For example, when the grinding interval is designated at a time of every 5000 sheets of paper, the numerical value is stored in a data ROM of a ROM 58. A CPU 52 starts counting the number of printed pages in a printed sheet counter field of the data ROM of the ROM 58 from the beginning of printing. Every count is compared with the numerical value designating the grinding interval by the number of printed sheets of paper. When the number of the printed sheets of paper exceeds 5000 sheets and the printing processing is paused, the CPU 52 instructs a printer interface 55 to press the cleaning belt onto and to grind the primary transfer roller 6. The printer interface 55 transfers the instruction to the printer 56 to start grinding. Requests for printing, if any, are reserved until grinding has been completed.

The cleaning belt 8 is instructed to press on the primary transfer roller 6 to grind the rubber layer 5 of the primary transfer roller into a thickness of 3 to 10 microns.

Returning to the explanation of FIG. 2, a sensor 32 transfers its recognition of page changes to the control panel 33 by counting the number of sheets of paper. The control panel 33 informs the CPU 52 of page changes with interrupt signals to start counting of the number of the printed sheets of paper. When the designated number of the printed sheets of paper has been attained and the printing process is paused, the CPU 52 instructs grinding as described above. As a result, the cam 34 rotates along the direction of an arrow 36 by the action of a power unit and a power transfer mechanism (not shown) to press the grinding layer 12 onto the surface layer of the primary transfer roller 6 together with the case 35 housing the cleaning belt 8. The surface layer of the primary transfer roller 6 is subsequently ground by driving the grinding rollers 30 and 31.

The number of printed sheets of paper before starting grinding can be defined by users. While the number of sheets has been defined herein to be 5000 sheets, the number of the sheets can be freely determined in relation to the quality of printed letters. It is also possible for the user to instruct grinding from the operation panel 57 at any timing, irrespective of the periodic grinding cycle depending on the prescribed number of sheets of paper.

Since an appropriate grinding effect cannot be obtained when the circumference speed of rotation of the grinding layer 12 is the same as the circumference speed of the rubber layer 5 of the primary transfer roller, the circumference speed of rotation of the grinding layer is set either to be faster or slower relative to the circumference speed of the rubber layer 5 of the primary transfer roller. However, the speed is finally determined to be able to obtain a desirable surface condition after grinding depending on the qualities of the grinding member and rubber layer 5 of the primary transfer roller.

The grinding powder generated by grinding is trapped in the meshes of the grinding layer 12 and left behind in the grinding layer 12. The grinding layer 12 pauses a distance apart from the surface of the rubber layer 5 of the primary transfer roller after rotating for a given time by being pressed on the surface of the rubber layer, and normal printing operation resumes. The numerical value of the printed sheet counter in the ROM 54 is initialized to zero after completing cleaning.

As is evident from the foregoing descriptions, the present invention exhibits the following effects.

1. Since depleted portions can be removed by providing a mechanism for shaving off the surface of the primary transfer roller 6, critical surface tension required for the primary and secondary transcriptions can be appropriately maintained on the surface of the primary transfer roller 6.

2. The cleaning roller 3 for removing the residual ink not transferred on the sheet of printing paper 19 from the surface of the primary transfer roller 6 is partitioned from the cleaning belt 8 for grinding the depleted surface. As a result, plugging of the cleaning belt 8 with the residual ink can be retarded.

3. The cycle for grinding can be elongated by making the cleaning mechanism to be a belt, thereby enabling the service life between the grinding cycles to be prolonged.

4. The grinding powder can be held on the grinding cloth by using a cloth for the grinding layer. Consequently, wet cleaning process of the surface of the primary transfer roller 6 after grinding can be omitted.

What is claimed is:

1. A transfer and fixing device for an electrophotographic image forming apparatus comprising:

a primary transfer roller onto which a toner image formed on a photosensitive member is transferred from the photosensitive member by a difference of critical surface tension between the roller and the photosensitive member, the transferred toner image being transferred onto a sheet of printing paper by a difference of critical surface tension between the roller and the sheet of printing paper;

a cleaning belt for grinding the surface layer of the primary transfer roller to remove deteriorated portions on the surface layer of the primary transfer roller by allowing the belt to press onto the surface of the primary transfer roller; and two rollers for allowing the cleaning belt to revolve, wherein the cleaning belt is positioned adjacent to the primary transfer roller between a first point at which the toner image is transferred onto the primary transfer roller from the photosensitive member and a second point at which the toner image is transferred onto the sheet of printing paper, with the cleaning belt being positioned before the second point in a direction of rotation of the primary transfer roller.

2. A transfer and fixing device for an electrophotographic image forming apparatus according to claim 1, wherein a grinding cloth is used for a grinding layer of the cleaning belt to enable grinding powder generated during grinding to be held on the grinding cloth.

3. A transfer and fixing device for an electrophotographic image forming apparatus according to claim 1, comprising a cleaning roller for removing toner left behind on the surface layer of the primary transfer roller after printing onto the sheet of printing paper, wherein the cleaning roller is positioned adjacent to the primary transfer roller between the second and first points and after the second point in the direction of rotation of the primary transfer roller.

4. A transfer and fixing device for an electrophotographic image forming apparatus according to claim 1, wherein the cleaning belt is pressed onto the surface layer of the primary transfer roller by allowing a case housing the cleaning belt and the two rollers to travel with a cam.

5. A transfer and fixing device for an electrophotographic image forming apparatus according to claim 1, comprising a cleaning roller for removing residual ink on the primary transfer roller that has not been transferred onto the sheet of printing paper, wherein the cleaning roller is positioned adjacent to the primary transfer roller between the second and first points and after the second point in the direction of rotation of the primary transfer roller.

6. A transfer and fixing device for an electrophotographic image forming apparatus according to claim 1, wherein a timing for grinding the surface layer of the primary transfer roller with the cleaning belt is set depending on the number of printed sheets of printing paper.

7. A transfer and fixing device for an electrophotographic image forming apparatus according to claim 6, wherein the number of printed sheets of printing paper for setting the timing of grinding can be arbitrarily determined by a user.

8. A transfer and fixing device for an electrophotographic image forming apparatus according to claim 6, wherein grinding with the cleaning belt is carried out when printing is suspended after a prescribed number or more of printing paper has been printed.

* * * * *